United States Patent [19]

Tellander et al.

[11] 4,275,713

[45] Jun. 30, 1981

[54] HYDROMASSAGE AIR INJECTOR APPARATUS

[76] Inventors: Linn Tellander, Box 1250, Black Canyon Stage, Phoenix, Ariz. 85029; Billy J. Lord, P.O. Box 9995, Phoenix, Ariz. 85068

[21] Appl. No.: 124,127

[22] Filed: Feb. 25, 1980

[51] Int. Cl.[3] ..... A61H 9/00

[52] U.S. Cl. ..... 128/66; 4/491

[58] Field of Search ..... 128/66, 65; 4/172.16, 4/172.17, 178, 180

[56] References Cited

U.S. PATENT DOCUMENTS

| | | | |
|---|---|---|---|
| 3,977,027 | 8/1976 | Speck | 4/172.16 |
| 4,082,091 | 4/1978 | Raab | 128/66 |
| 4,166,296 | 9/1979 | Darrah et al. | 4/178 |
| 4,220,145 | 9/1980 | Stamp et al. | 128/66 |

*Primary Examiner*—John D. Yasko

*Attorney, Agent, or Firm*—H. Gordon Shields

[57] ABSTRACT

Hydromassage air injector apparatus includes a head assembly movable from one location to another location and which includes an air tube disposed within a water supply tube.

14 Claims, 5 Drawing Figures

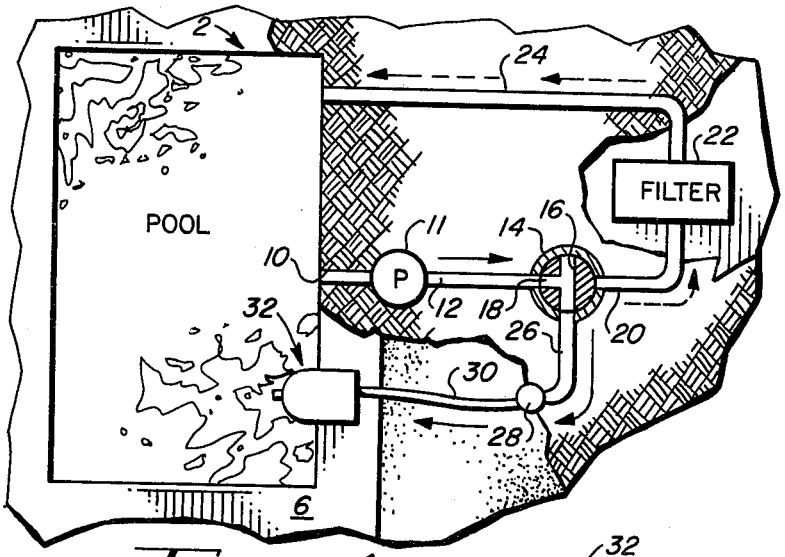
FIG. 1
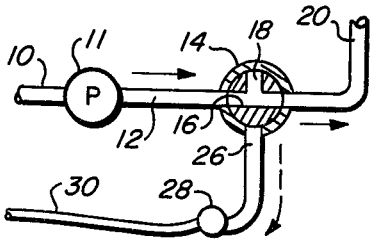
FIG. 1A
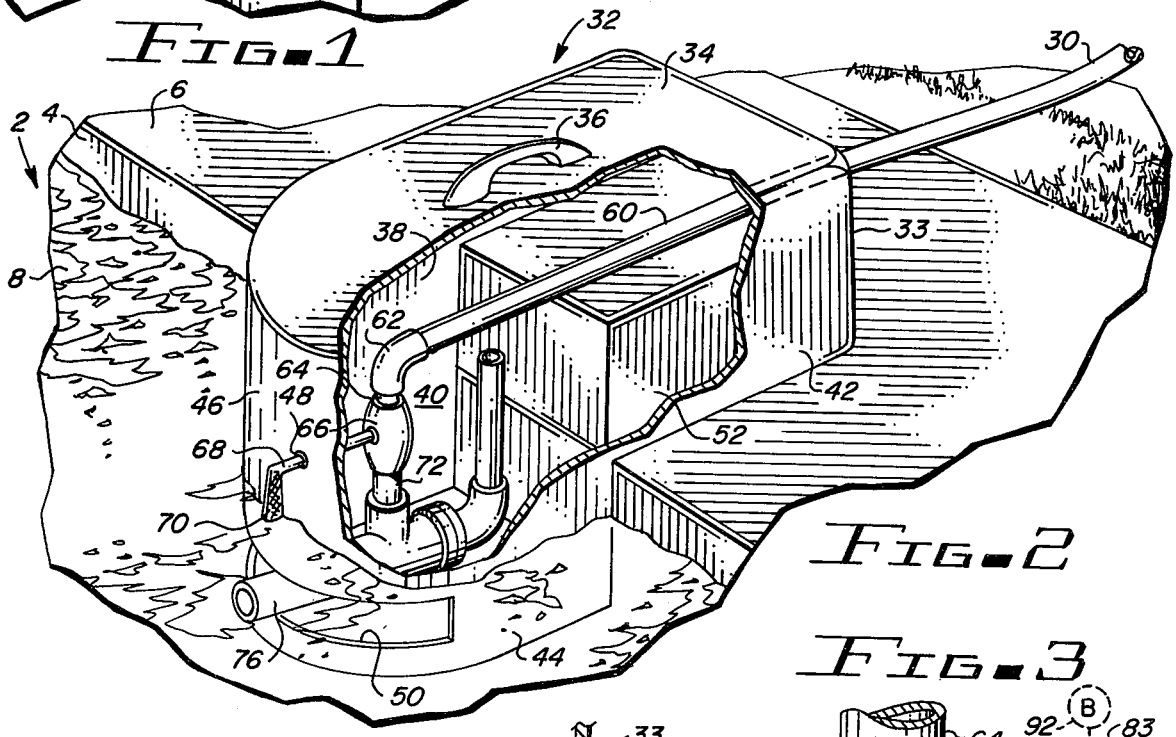
FIG. 2
FIG. 3
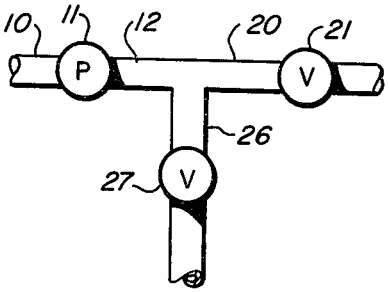
FIG. 1B
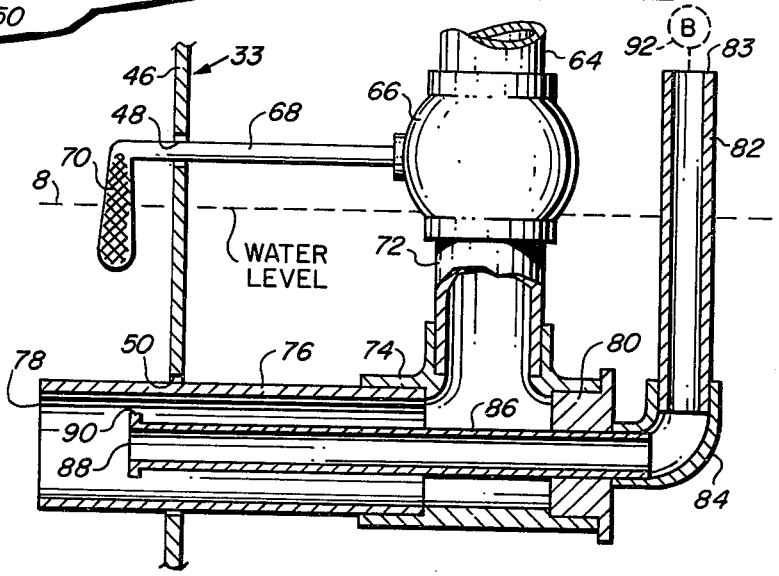

HYDROMASSAGE AIR INJECTOR APPARATUS

BACKGROUND OF THE INVENTION

1. Field of the Invention

This invention relates to hydromassage apparatus, and, more particularly, to a hydromassage apparatus having an air injector system for introducing air into a flow of water.

2. Description of the Prior Art

The field of hydromassage therapy is not a new field. Rather, the value of combining air and water is well known and accepted. For combining the air and water, there are several different types of air injector systems. The term "air injector" refers to the injecting or combining of the air and water. The following group of patents relate to one type of system in which the air supply pipe is disposed within the water supply pipe. The flow of water over or around the end of the air supply pipe, and outwardly into a pool, bath, or the like, results in the combining of the air and the water.

U.S. Pat. No. 3,496,933 discloses an oral cleaning apparatus using air and water. The water is mixed with a cleaning solution and the water and cleaning solution mixture is in turn subject to air pressure prior to discharge through a nozzle. The air injection tube is disposed in the middle of a water supply conduit and the air injector tubing terminates slightly before, or upstream of, the end of the water discharge nozzle.

U.S. Pat. No. 3,672,359 discloses a pair of substantially coaxial conduits, with the center conduit comprising an air conduit, and the outer conduit comprising a water delivery conduit or tube. The air conduit terminates upstream from the end of the outer conduit. The outer conduit includes a restriction extending upstream from the end of the outer conduit. The outer conduit includes a restriction extending upstream from the discharge end of the conduit and terminating slightly upstream of the end of the air conduit.

U.S. Pat. No. 3,905,358 discloses a nozzle apparatus in which a water conduit includes an air injector conduit disposed within the water conduit. The water conduit includes a nozzle, and the air conduit terminates upstream from the throat of the nozzle. The throat of the nozzle is the narrowest portion of the nozzle, or the portion of the nozzle with the least diameter, and the air conduit terminates upstream from the throat. The nozzle comprises a venturi, with the overall cross-sectional of the nozzle at its greatest diameter substantially less than the overall diameter of the water supply pipe.

U.S. Pat. No. 4,082,091, in general terms, discloses a nozzle apparatus similar to that of the '358 patent. The same general venturi type nozzle, with a water supply pipe leading directly into the nozzle, and an air injector pipe terminating upstream from the throat of the nozzle is disposed in the '091 patent, and the overall systems are substantially identical to each other. The '359 apparatus uses household water pressure, which is normally 50–60 psi. The '358 and '091 apparatus typically require high head pumps, with output pressures of 25–35 psi.

There are numerous patents in which the water supply pipe is disposed within the air supply pipe. Rather than having the air supply pipe disposed within a flow of water, the flow of water is disposed within an outer, air supply pipe. Examples of such an air injector system are illustrated in U.S. Pat. Nos. 2,738,787, 3,288,134, and 3,745,994.

Another type of injector apparatus for combining air and water is disclosed in U.S. Pat. No. 3,587,976, in which the air is injected into a water stream forward of the throat of a nozzle. A similar way of injecting air into a stream of water is shown in U.S. Pat. No. 3,628,529. U.S. Pat. No. 3,810,464 also discloses the air supply conduit downstream from the throat of a water supply nozzle.

The air injector systems discussed above generally result in a bubble bath or effervescent effect of the combination of air and water. The ratio of water to air by volume is restricted to about a 50—50 ratio, or in some cases an even lower ratio of water to air. In the latter case, there will be more air than water in the combination and accordingly an increase in the bubble bath type effect. The design of the particular air injector system, or head, as it may be referred to, is therefore determinative as to the net, or overall, effect of the stream of air and water which flows from the hydrotherapy massage system.

In the apparatus of the present invention, air is generally not entrained in the flow of water. Rather, the air effects a breaking up of the continuous or solid flow of the water to provide a pulsating or rhythmic flow of the water against the user of the apparatus. This is different from the apparatus of the prior art, as exemplified by the patents discussed above. The air injector system or head of the present invention results in a flow of air with the flow of water, as contrasted with the bubbly or effervescent effect of the air bubble and water type air injections of the hydrotherapy massage units of the prior art. The apparatus of the present invention results in a stream of water and a stream of air, as opposed to the prior art apparatus which produce a flow of air and water bubbles.

Generally speaking, the effectiveness of a hydrotherapy massage unit varies with the ratio of the stream of air and water emanating from the unit. However, in addition to the effectiveness of a particular nozzle in an air/water unit, another factor is also of importance, and that is the ability to direct the air/water flow from an air injector head to the desired part of the body. This may involve the ability of moving the head of the unit from one location to another location. A detriment to such arrangement is, of course, having the hydromassage units fixed at a particular location. On the other hand, there are substantial advantages to being able to move the head from one location to another. For the use or placement of such hydromassage units or air injector heads in conjunction with a pool, the ability to move the unit from one location on a pool to another location allows substantial flexibility in the end use of the apparatus. The results to be derived from such portability means that a unit may be moved from one part of a pool, where it may be used to massage a portion of a user's body at a particular location or depth of a pool, to another location at the pool where it will be most advantageously used to provide hydromassage therapy to another part of the body. For example, a person standing in a relatively shallow portion of a pool may direct the air/water stream at a lower part of the user's back. By moving the unit to a deeper portion of the pool, the user may remain in a standing position, but the air/water stream may be directed to the user's back or shoulder area. By moving the unit to the extreme shallow portion of the pool, the user may sit on the steps of the pool and have the flow of air and water directed at a foot, leg, or the like. Obviously, such advantages are not possible with a unit disposed at a fixed location.

U.S. Pat. No. 3,674,020 discloses a portable hydromassage unit usable with a swimming pool. The apparatus is self-contained, except that it requires an electrical connection for its operation. A substantial disadvantage of such unit is the requirement of an electrical conductor between the unit and a source of electrical current adjacent the water. The self-contained unit itself includes an electrical motor for providing power for its own water pump. The unit also includes a water intake to provide the required water supply for the pump. The water intake at the unit comprises a potential hazard due to the suction or intake force of the pump. The present apparatus utilizes a high volume, low head pump, as opposed to the prior art high head, low volume pumps. U.S. Pat. Nos. 3,292,615, 3,961,382, and 4,127,117 disclose portable systems adapted to be disposed on the sides of bathtubs. U.S. Pat. Nos. 3,286,712 and 3,534,730 disclose systems placed adjacent a bathtub with a flexible connection between the unit and a nozzle within the tub. U.S. Pat. No. 3,336,921 discloses a self-contained, water-proofed unit disposed within a tub, with an electric cord extending to a source of electrical current. U.S. Pat. No. 4,149,281 discloses a floating system for a swimming pool.

SUMMARY OF THE INVENTION

The invention described and claimed herein comprises a hydromassage therapy unit having a pair of partially coaxial conduits, the inner of which is an air conduit and the outer of which is a water supply conduit. A restriction is placed about the end of the air supply conduit to provide turbulence for the water flow for mixing the air and water. The apparatus may be built into a pool, as a fixed location unit, or it may be portable to allow it to be moved from one location to another, as desired by the user.

Among the objects of the present invention are the following:

To provide new and useful hydromassage therapy apparatus;

to provide new and useful apparatus for mixing air into a flow of water;

to provide new and useful air and water nozzle apparatus;

to provide new and useful air and water nozzle apparatus for hydromassage therapy; and to provide new and useful apparatus for combining a flow of air with a flow of water.

BRIEF DESCRIPTION OF THE DRAWING

FIG. 1 is a schematic representation of a pool and its water circulation system illustrating the employment of the apparatus of the present invention therewith.

FIG. 1A comprises an enlarged view of a portion of FIG. 1 illustrating one aspect of the water circulation system.

FIG. 1B is a schematic representation of an alternate valve system for use with the apparatus of the present invention.

FIG. 2 comprises a perspective view of the apparatus of the present invention, partially broken away, in an environment of the pool illustrated in FIG. 1.

FIG. 3 is an enlarged view in partial section of a portion of the apparatus of FIG. 2.

DESCRIPTION OF THE PREFERRED EMBODIMENT

FIG. 1 comprises a top, schematic view of a swimming pool 2 illustrating the employment of the apparatus of the present invention with the swimming pool 2. The pool 2 includes a water intake line or conduit 10 extending from the pool to a pump 11. The pump 11 circulates the water from the pool either to a filter 22 or to a portable hydrotherapy massage unit 32 through a conduit 12 and a valve 14. The valve 14 is shown as a multi-port valve connected to three conduits 12, 20, and 26. The conduit 12, which extends from the pump 11 outlet or discharge port to the valve 14, comprises the input or supply line for the valve 14. The valve 14 includes an inner movable element having a pair of internal conduits. The internal or interior conduits includes a diametrically extending conduit 16 and a radially extending intersecting conduit 18. The conduit 18 intersects the conduit 16, and extends radially outwardly therefrom. In FIG. 1, the intersecting conduit 18 is shown connected to the conduit 26 by way of the conduit 16.

The conduit 26 is in turn connected to a coupler 28. A flexible water supply line or conduit 30 extends from the coupler 28 to the portable hydrotherapy massage unit 32. The unit 32 may be considered as a portable spa, comprising a portable air injector head for injecting a flow of air into a flow of water. It will be noted that the conduits or pipes 10, 12, and 26 may be disposed beneath the surface of the ground, with the coupler 28 disposed at about ground level for convenience of connecting the flexible water supply line 30 to the coupler. Additional couplers may be employed, if desired, to give greater flexibility to the overall system. Such additional couplers, with appropriate valving and connecting water supply lines, may be employed to allow a portable unit to be located virtually anywhere with respect to a pool, and without regard to the size of the pool. If desired, such additional couplers may be used with additional heads or units to allow the simultaneous use of more than one unit. In such cases, of course, the pump capabilities or needs and conduit sizes will have to be taken into consideration for the additional couplers and units.

The valve 14 may also be disposed beneath the ground, if desired, with a valve actuation handle extending above ground for convenience in actuating the valve 14.

FIG. 1A is an enlarged view of the valve 14, and of the associated conduits or lines connected therewith. The valve 14 is turned ninety degrees from the position shown in FIG. 1 to allow the diametrically extending internal conduit 16 to provide a fluid connection between the conduit 12 and the conduit 20. This allows the water from the pool 2 from the supply line or conduit 10 to be pumped by the pump 11 to the conduit 12, through the valve 14 and the conduit 20 to the filter 22. From the filter 22, shown in FIG. 1, the water is returned, after filtering, by a conduit or line 24 to the swimming pool 2.

FIG. 1B is a schematic representation of an alternate valve arrangement usable with the apparatus of the present invention. Rather than employing a single valve 14, as illustrated in FIGS. 1 and 1A, the apparatus of FIG. 1B utilizes two separate valves, one valve in conduit 20, and another valve in conduit 26. The conduits 20 and 26 are connected to the conduit 12 by an appropriate tee. The pair of valves, comprising a valve 21 in conduit 20 and a valve 27 in conduit 26, are preferably disposed relatively close together and adjacent the tee connection of the three lines or conduits 12, 20, and 26. The use of the separate valves 21 and 27 insures that the full flow of water from the swimming pool 2 through the conduit 10, and pumped by the pump 11, flows either through the filter 22 or through the portable unit or spa 32.

Any appropriate valve arrangement may be utilized with the apparatus of the present invention, such as a single valve as shown in FIGS. 1 and 1A, or a double valve arrangement as shown in FIG. 1B. For multiple couplers, additional lines or conduits and/or valves may be needed.

FIG. 2 is a perspective view of the portable hydrotherapy massage unit 32, with a portion broken away. The unit 32 is shown disposed in its use environment at the pool 2. The broken away portion of the portable unit 32 of FIG. 2 shows the air injector and nozzle of the unit. The air injector and nozzle may be referred to as the air injector assembly or head. FIG. 3 is a view in partial section of a portion of the air injector head of FIG. 2. Reference will be made primarily to FIGS. 2 and 3 for the following discussion concerning the operation of the portable hydrotherapy massage unit 32.

The portable unit 32 includes a housing 33 in which is disposed an air injector assembly. The air injector assembly introduces air into the stream of water flowing from the pool 2, through the pump 11, and through the conduits 26 and 30. The housing 33 is configured to allow the portable unit to be disposed at the sides of a swimming pool, such as the pool 2. The swimming pool, as best shown in FIG. 2, includes a generally vertically extending side 4, with water in the pool generally designated by reference numeral 8. A deck 6 extends outwardly from the sides 4 of the pool 2. The deck 6 is disposed at the outer periphery of the pool. While a foursided rectangular pool is illustrated herein, the particular configuration or size of the pool is immaterial to the present invention. Similarly, the type of decking 6 about the pool, or its extent, linearly away from each side 4, is immaterial. The unit 32 simply is placed at the edge of the pool, with the forward, or front, portion of the unit extending into the pool, as best shown in FIG. 2.

The level of the water 8 within the pool 2 is spaced downwardly a few inches from the top of the side 4, as is well known and understood. The portable unit 32 is disposed on the deck 6, with a portion of the unit extending into the pool 2 and downwardly beneath the level of the water 8.

The housing 33 of the portable unit 32 includes a housing top 34. A handle 36 is secured to the housing top 34 to allow the portable unit 32 to be carried from one location to another. Extending downwardly from the housing top 34 are a pair of side panels 38 and 42. The side panels 38 and 42 include lower front portions 40 and 44, respectively, which are disposed at the forward or front edge of the unit and which are adapted to be disposed within the pool, with the rearward portions of the side panels 38 and 42 disposed on the deck 6.

The front of the housing 33 for the portable unit 32 comprises a rounded front portion 46. The front 46 extends in an arcuate configuration between the side panels 38 and 42 and vertically downwardly from the top 34 to include the lower side panels 40 and 44. The arcuate curvature of the front 46 allows for the rotation of a nozzle conduit 76 of the air injector assembly disposed within the housing 33. This will be discussed in detail below. The side panels 38 and 42, and the upper portion of the front 46, with the top 34, comprise an upper portion of the air injector head unit 32, and the lower front panels 40 and 44 comprise a lower portion of the unit. Additional elements of the upper and lower portions include the conduits, nozzles, etc., disposed within the housing 33 and are discussed below. The upper portion is basically that portion of the unit which is above water and on the deck, and the lower portion is that portion which is below the deck and in the water.

An aperture 48 extends through the front portion 46 to accommodate a rod 68. The rod 68 extends through the aperture 48 to a valve 66 disposed within the housing. The valve 66 is part of the air injector assembly. A handle 70 is secured to the rod 68 outside the housing. The handle 70 is used to adjust the valve 66. Below the aperture 48 is a slot 50 which extends arcuately and generally horizontally between the lower side portions 40 and 44 and through the front portion 46 of the housing 33. The nozzle 76 extends through the slot 50 and is movable therein to direct the flow of water and air over a substantial arcuate length, such as nearly 180 degrees.

Secured within the housing 33, and disposed at the rear of the housing adjacent the deck 6, is ballast 52. The ballast 52 is shown as a generally rectangular block which extends between the sides 38 and 42 of the housing 33. It is understood that the ballast may be any appropriate material. The purpose of the ballast is to provide weight for the portable unit 32, to anchor the unit in place, as desired, to prevent movement of the unit under the reaction of the water and air emanating from the nozzle 76.

The flexible line or conduit 30 extends from the coupler 28 (see FIG. 1) to the housing 33 of the portable unit 32. The flexible conduit 30 is secured at the housing 33 to a conduit 60 disposed within the housing 33. The conduit 60 is shown in FIG. 2 between the top 34 and the ballast 52. An elbow 62 connects the conduit 60 to a relatively short length of conduit 64. The conduit 64 extends to the valve 66. The valve 66 may be any appropriate valve, such as a ball valve, the purpose of which is to control the flow of water from the conduit 60 to the nozzle 76. For safety purposes, the valve 66 preferably includes a relatively small internal bore which allows a flow of water through the unit 32 when the valve is in the closed position. This ensures that the pump 11 will not be damaged due to the blockage or stoppage of the water flow from the pump in the event that the valve 66 is turned off without a corresponding adjustment of the valve 14 of FIGS. 1 and 1A or the valves 21 and 27 of FIG. 1B to direct the flow of water from the pump 11 through the filter 22.

As illustrated in FIGS. 2 and 3, the handle 70 is aligned parallel to the conduit 64 and to the valve 66. In this position, the valve 66 is open, allowing the full flow of water from the pump 11, the conduits 26, 30, and 60 to flow to the nozzle 76. A rotation of the handle 70 from the position shown in FIGS. 2 and 3 results in the adjustment of the valve 66. The adjustment in turn causes the flow of water through the portable unit 32 to vary from full flow or force to any degree of lesser force or "off," except for the safety flow discussed above. The valve 66, with the rod 68 and handle 70 as integral parts thereof, is accordingly a flow control element.

Beneath the valve 66 is another relatively short length of conduit 72 which extends to the nozzle 76. A tee 74, best shown in FIG. 3, connects the valve 66 and the conduit 72 to the nozzle 76. The end of the tee 74 remote from the nozzle 76 is closed by a reducer bushing 80. The reducer bushing 80 includes a bore extending longitudinally through the bushing. An air conduit 86 is secured within the bore of the bushing 80. The air conduit 86 is disposed within the nozzle 76 generally or partially coaxial therewith.

The nozzle 76 extends from the tee 74 outwardly through the slot 50 in the front 46 of the housing 33 and it terminates in an end 78 externally of the housing 33. The connection between the valve 66 and the conduit 72 is such that the nozzle 76 and the conduit 72 are movable through an arc of nearly 180 degrees. This allows the water and air flowing through the nozzle 76 to be directed, as desired, by a user of the apparatus 32.

The air conduit 86 is connected by an elbow 84 to an open intake air conduit or air pipe 82. The air pipe 82 extends upwardly within the housing 33 and terminates in an open top or upper end 83 above the level of the water 8. The distance is sufficient to ensure that the upper end 83 of the pipe 82 is above the level of the water 8 and beneath the conduit 60 so that the pipe 82 will not interfere with the conduit 60 when the nozzle 76 is moved back and forth in an arc. Since the air conduits 82 and 86 are secured to the conduit or nozzle 76, they move with the nozzle 76.

The relative diameters of the water nozzle 76 and the air conduit 86 is such that there is a full flow of water through the conduits 60, 64, the valve 66 and the conduits 72 and 76 about the air pipe 86. The air pipe 86 terminates at an end 88 within the nozzle conduit 76 and spaced apart from the end 78 of the nozzle conduit 76. A collar 90 is disposed about the air conduit 86 at its end 88.

The flow of water about the air conduit 86 and within the nozzle 76, and over the collar 90, results in an increase in the velocity of the flow of water with a corresponding decrease in the pressure of the water adjacent the end 88 of the air nozzle or air conduit 86. This in turn results in air being forced by atmospheric pressure through the pipe 82 and through the conduit 86, and out through the end 88 of the pipe 86 and into the stream of water.

The stream of water and air which emits from the nozzle 76 is not a bubble stream, as is typical with the prior art. Rather, it is a pulsing jet of water with a center cone of air. The air appears to cause the jet of water from the normal water flow to be broken up and accelerated, to provide a relatively strong pulsating effect.

In the drawing and in the specification heretofore, the apparatus 32 is referred to in conjunction with a typical swimming pool 2 which includes a deck 6 disposed about the periphery of the pool, and the apparatus is at the edge of the pool, supported by the deck and extending into the pool. It will be understood that the apparatus 32 may be used in conjunction with a molded or one piece pool with an integral apron or deck, whether the pool is in the ground or above the ground, or with an above ground pool using a special platform, fixed or movable, to support the apparatus at the edge of the pool.

Moreover, the apparatus 32 may be used with a much smaller "pool" than shown and discussed. For example, the apparatus may be used with a vessel accommodating only a body member, such as an arm or leg, or accommodating the lower portion of a body, or with a bathtub or bathtub-sized vessel, if desired, and a recirculating system must be used. Under such circumstances, the air injector head may be fixed in place, if desired.

To aid in holding the injector head in place within the housing 33, the pipe or conduit 60 may preferably be disposed within the ballast 52, rather than being disposed on or above the ballast, as shown in FIG. 2. The ballast 52 is preferably poured or cast within the housing 35, and the conduit 60 is accordingly easily fixed in place and the ballast then cast or poured over and around it.

In FIG. 3, the air pipe 82 is shown terminating in an open end 83. The air pipe is thus open, or subject, to atmospheric pressure. The atmospheric pressure is normally sufficient to provide a sufficient flow of air through the air pipe 82 and into the air conduit or nozzle 84. However, under some circumstances it may be preferable to use a blower to provide a flow of air to the air pipe 82 at a pressure above atmospheric. Accordingly, in FIG. 3 there is shown in phantom a schematic representation of a blower 94 connected to the air pipe 82. The connection is preferably by flexible hose or conduit adjacent the flexible water conduit 30.

The blower 94 is remote from the unit 32 to obviate the possible hazard of an electrical current at the unit, as discussed above. The flexible air line or hose accordingly allows the unit 32 to be positioned as desired. In the alternative, as also discussed above, such pressurized air line may be used with a fixed or permanent installation.

As the injector head is lowered beneath the surface of the water, the effectiveness of the atmospheric pressure decreases. When the nozzle 76 is located more than a few inches below water level, the blower 92 becomes increasingly desirable. With the nozzle 76 located below about twelve inches or so, the use of the blower is required to provide the air necessary for the effectiveness of the unit.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. For example, the handle and housing top may require reinforcement; the ballast may be configured differently from that shown, etc. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Portable hydromassage therapy apparatus adapted for use with a pool containing a quantity of water and having a side and a deck adjacent the side and having a water circulation system, including a pump for drawing water out of the pool and returning the water to the pool, comprising, in combination:

a flexible conduit coupled to the water circulation system for receiving a flow of water from the pump;

head means connected to the flexible conduit and movable for positioning on the deck at the side of the pool, and including a portion disposed in the quantity of water in the pool, including a first conduit connected to the flexible conduit for receiving a flow of water therefrom, a second conduit movably connected to the first conduit and extending from the first conduit to an end disposed in the quantity of water and receiving the flow of water from the first conduit, air pipe means adjacent the first and second conduits for providing a flow of air, an air conduit connected to the air pipe means and extending within the second conduit and terminating at an end within the second conduit a predetermined distance from the end of the second conduit for receiving the flow of air from the air pipe means, and collar means disposed on the air conduit for disturbing and accelerating the flow of water within the second conduit and about the air conduit, the flow of water within the second conduit and about the air conduit and the collar providing a flow of water and air from the end of the second conduit.

2. The apparatus of claim 1 in which the head means further includes a housing having an upper portion disposed on the deck and a lower portion disposed adjacent the side of the pool and extending into the water in the pool.

3. The apparatus of claim 2 in which the head means further includes a slot in the lower portion of the housing and the second conduit extends through and is movable in the slot to direct the flow of water and air therefrom.

4. The apparatus of claim 1 in which the collar means comprises a collar secured to the air conduit at its end within the second conduit.

5. The apparatus of claim 1 in which the head means further includes a valve for controlling the flow of water through the second conduit.

6. The apparatus of claim 5 in which the valve of the head means is disposed between and secured to the first and second conduits.

7. The apparatus of claim 1 in which the air pipe means comprises an air pipe extending at least partially above the quantity of water and open to air at atmospheric pressure.

8. The apparatus of claim 1 in which the air pipe means comprises an air pipe and a blower for providing the flow of air to the air pipe.

9. An air injector head for injecting air into a flow of water, comprising, in combination:

first conduit means for providing a flow of water;

a nozzle conduit connected to the first conduit and including an end remote from the first conduit;

air pipe means for providing a flow of air;

an air conduit connected to the air pipe means and disposed within the nozzle conduit and having an end within the nozzle conduit spaced apart from the end of the nozzle conduit for receiving the flow of air from the air pipe means; and a collar secured to the air conduit within the nozzle over which the water flows for disturbing and accelerating the flow of water within the nozzle conduit, the flow of water past the end of the air conduit injecting the flow of air from the air conduit into the flow of water through the nozzle conduit and out past the end of the nozzle conduit.

10. The apparatus of claim 7 in which the collar is disposed on the air conduit adjacent the end of the air conduit.

11. The apparatus of claim 8 in which the nozzle conduit is movably connected to the first conduit means.

12. The apparatus of claim 9 in which the first conduit means includes a valve for controlling the flow of water to the nozzle conduit.

13. The apparatus of claim 9 in which the air pipe means includes an air pipe open to atmospheric pressure for providing air at atmospheric pressure to the air conduit.

14. The apparatus of claim 9 in which the air pipe means includes a blower for providing a flow of air at a pressure greater than atmospheric pressure to the air conduit.

* * * * *